US007808459B2

(12) United States Patent
Lee et al.

(10) Patent No.: US 7,808,459 B2
(45) Date of Patent: Oct. 5, 2010

(54) LIGHT EMITTING DISPLAY DEVICE

(75) Inventors: Myung Ho Lee, Gyeonggi-do (KR); Seong Ho Baik, Gyeonggi-do (KR); In Hwan Kim, Seoul (KR); Seung Chan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 684 days.

(21) Appl. No.: 11/476,847

(22) Filed: Jun. 29, 2006

(65) Prior Publication Data

US 2007/0013621 A1 Jan. 18, 2007

(30) Foreign Application Priority Data

Jun. 29, 2005 (KR) ..... 10-2005-0056831

(51) Int. Cl.
*G09G 3/30* (2006.01)

(52) U.S. Cl. ..... 345/77; 345/63; 345/89; 382/192

(58) Field of Classification Search ..... 345/63, 345/76, 77, 82, 89, 84; 382/199, 192, 203
See application file for complete search history.

(56) References Cited

U.S. PATENT DOCUMENTS 5,710,594 A * 1/1998 Kim ..... 348/254
7,164,400 B2 * 1/2007 Mizukoshi et al. ..... 345/76
2002/0012468 A1 * 1/2002 Togashi et al. ..... 382/229
2004/0164938 A1 * 8/2004 Choi et al. ..... 345/76
2005/0093958 A1 * 5/2005 Mori et al. ..... 347/207
2005/0162361 A1 * 7/2005 Chuang et al. ..... 345/89
2005/0281466 A1 * 12/2005 Siah et al. ..... 382/199
2006/0001624 A1 * 1/2006 Lee ..... 345/82
2006/0114205 A1 * 6/2006 Shen et al. ..... 345/88
2006/0152452 A1 * 7/2006 Hoppenbrouwers et al. ... 345/77
2006/0170944 A1 * 8/2006 Arps et al. ..... 358/1.13

* cited by examiner

*Primary Examiner*—Amare Mengistu
*Assistant Examiner*—Dmitriy Bolotin
(74) *Attorney, Agent, or Firm*—Morgan Lewis & Bockius LLP

(57) ABSTRACT

A display device includes a pixel circuit unit comprising a plurality of pixels to display an image, a data driver to supply data signals to the pixel circuit unit, a scan driver to supply scan signals to the pixel circuit unit, a black/white transition detector to detect a degree of black/white transition of the image, a gamma corrector to adjust the data signal by providing a gamma value to the data driver, and a timing controller to apply control signals to the data driver and the scan driver, receive the degree of black/white transition from the black/white transition detector, and provide a corrected gamma control signal to the gamma corrector according to the degree of black/white transition.

13 Claims, 5 Drawing Sheets

LIGHT EMITTING DISPLAY DEVICE

This application claims the benefit of the Korean Patent Application No. 10-2005-0056831 filed on Jun. 29, 2005, which is hereby incorporated by reference.

BACKGROUND OF THE INVENTION

1. Field of the Invention

The present invention relates to a light emitting display device, and more particularly to a light emitting display device in which dynamic gamma values are converted and applied.

2. Discussion of the Related Art

A light emitting device used for light emitting display is a self-luminescent device in which a light emitting layer is formed between two electrodes. The light emitting device can be divided into an inorganic light emitting device and an organic light emitting device depending on the material used. The light emitting device can be further divided into a passive matrix type light emitting device and an active matrix type light emitting device.

FIG. 1 is a graph showing performance of a general light emitting display device in which a fixed gamma value is applied. As shown in FIG. 1, the general light emitting display device uses a fixed gamma value optimized for a particular test pattern situation. Accordingly, the general light emitting display device cannot suitably adapt for a multimedia display applications. Thus, when continuously displaying an image with high luminance, general light emitting device become degraded, resulting in a shortened life span.

In general, video images (i.e., moving pictures) require high luminance in order to display the high contrast between light and dark areas. Text-oriented images require relatively low luminance since readability is important. As a result, in the light emitting display, if unnecessarily high luminance is provided for text-oriented images with a full white background for readability, the life span of the light emitting display is shortened and its power consumption is increased.

SUMMARY OF THE INVENTION

Accordingly, the present invention is directed to a light emitting display device that substantially obviates one or more problems due to limitations and disadvantages of the related art.

An object of the present invention is to provide a light emitting display device that dynamically adjusts gamma values.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the display device comprise a pixel circuit unit comprising a plurality of pixels to display an image, a data driver to supply data signals to the pixel circuit unit, a scan driver to supply scan signals to the pixel circuit unit, a black/white transition detector to detect a degree of black/white transition of the image, a gamma corrector to adjust the data signal by providing a gamma value to the data driver, and a timing controller to apply control signals to the data driver and the scan driver, receive the degree of black/white transition from the black/white transition detector, and provide a corrected gamma control signal to the gamma corrector according to the degree of black/white transition.

In another aspect, the dynamic gamma control method in a display comprise receiving image data of an image to be displayed on a screen, outputting the image data onto the screen, detecting a degree of black/white transition of the image, and controlling luminance of the image output onto the screen by applying a gamma value that has been corrected according to the degree of black/white transition.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
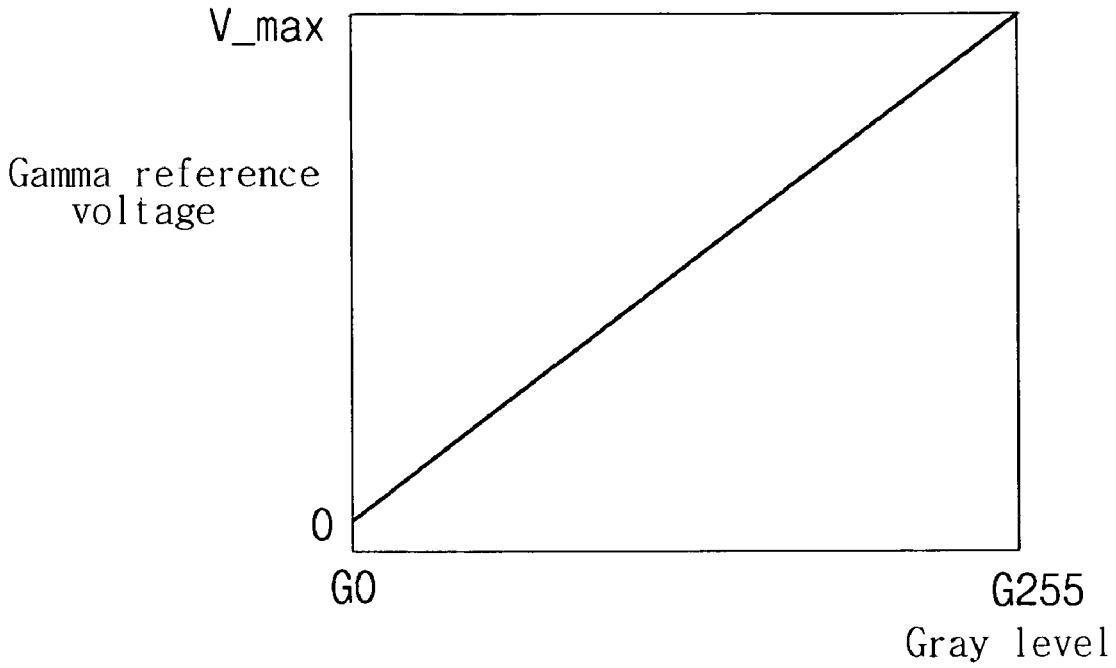
FIG. 1 is a graph showing performance of a general light emitting display in which a fixed gamma value is applied.
Figure 2:
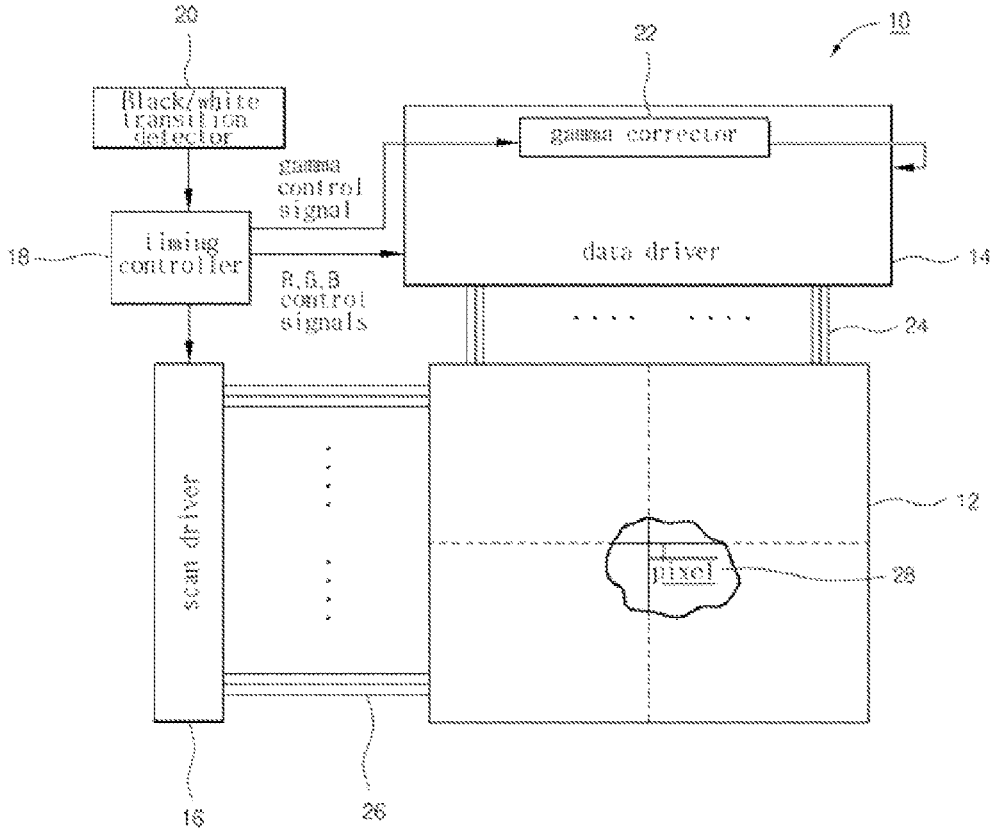
FIG. 2 is a schematic block diagram of a light emitting display device in accordance with an exemplary embodiment of the present invention.

FIG. 2 is a schematic block diagram of a light emitting display device in accordance with an exemplary embodiment of the present invention. As shown in FIG. 2, a light emitting display device 10 according to the exemplary embodiment of the present invention comprise a pixel circuit unit 12, a data driver 14, a scan driver 16, a timing controller 18, a black/white transition detector 20, and a gamma corrector 22.

The pixel circuit unit 12 comprises a plurality of light emitting diodes (LEDs) 28 where each LED defines a pixel. Each LED 28 is a self-luminescent device for illuminating a light emitting material, such as phosphor, by re-combining electrons and holes. Each LED comprise an organic light emitting layer, for example, formed at each position where data lines 24 and scan lines 26 cross. The pixel circuit unit 12 displays images on a screen via the plurality of LEDs 28. Other types of LEDs may be used without departing from the scope of the present invention.

The data driver 14 applies data signals to the LEDs 28 of the pixel circuit unit 12 through the data lines 24. A single data driver may be employed or two or more data drivers can be used without departing from the scope of the present invention. The scan driver 16 applies scan signals to select the LEDs 28 of the pixel circuit unit 12 through the scan lines 26. A single scan driver may be employed or two or more scan drivers can be used without departing from the scope of the present invention.

The timing controller 18 supplies red, green, and blue (R, G, B) control signals to the data driver 14 and supplies scan control signals to the scan driver 16. In addition, the timing controller 18 supplies gamma control signals to the gamma corrector 22 such that the gamma corrector 22 can control a gamma value to be provided to the data driver 14.

The gamma control signal from the timing controller 18 can differ according to a degree of black/white transition of an image to be displayed by the pixel circuit unit 12. In particular, the black/white transition detector 20 detects a degree of black/white transition of an image and provides a corresponding value to the timing controller 18.

The gamma corrector 22 receives a gamma control signal generated by the timing controller 18 according to the degree of black/white transition provided from the black/white transition detector 20. The gamma corrector 22 applies gamma values to the data driver 14 according to the gamma control signal. Accordingly, the data driver 14 supplies data signals each having a different luminance level to the pixel circuit unit 12 to thereby control luminance of the LEDs 28.

Figure 3:
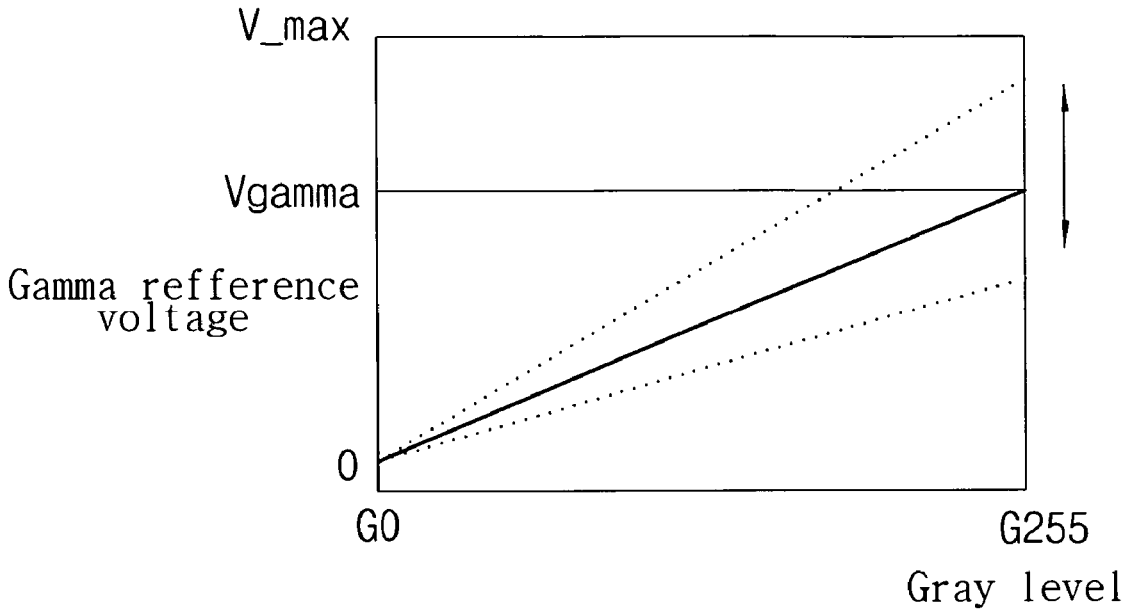
FIG. 3 is a graph showing application of dynamic gamma voltages in accordance with the exemplary embodiment of FIG. 2.

FIG. 3 is a graph showing application of a dynamic gamma voltage in accordance with the exemplary embodiment of the present invention. As shown in FIG. 3, if the degree of black/white transition of the image detected by the black/white transition detector 20 is low, the gamma corrector 22 provides a gamma reference voltage or gamma value lower than a gamma reference voltage or gamma value fixed at the general light emitting display (indicated by a solid line) to the data driver 14. On the other hand, if the degree of black/white transition of the image detected by the black/white transition detector 20 is high, the gamma corrector 22 provides a gamma reference voltage or gamma value higher than the gamma reference voltage or gamma value fixed at the general light emitting display to the data driver 14. That is, different gamma values are applied depending on the degree of black/white transition of images. In the present invention, application of the different gamma values according to the degree of black/white transition of the image is referred to as dynamic gamma control.

Figure 4:
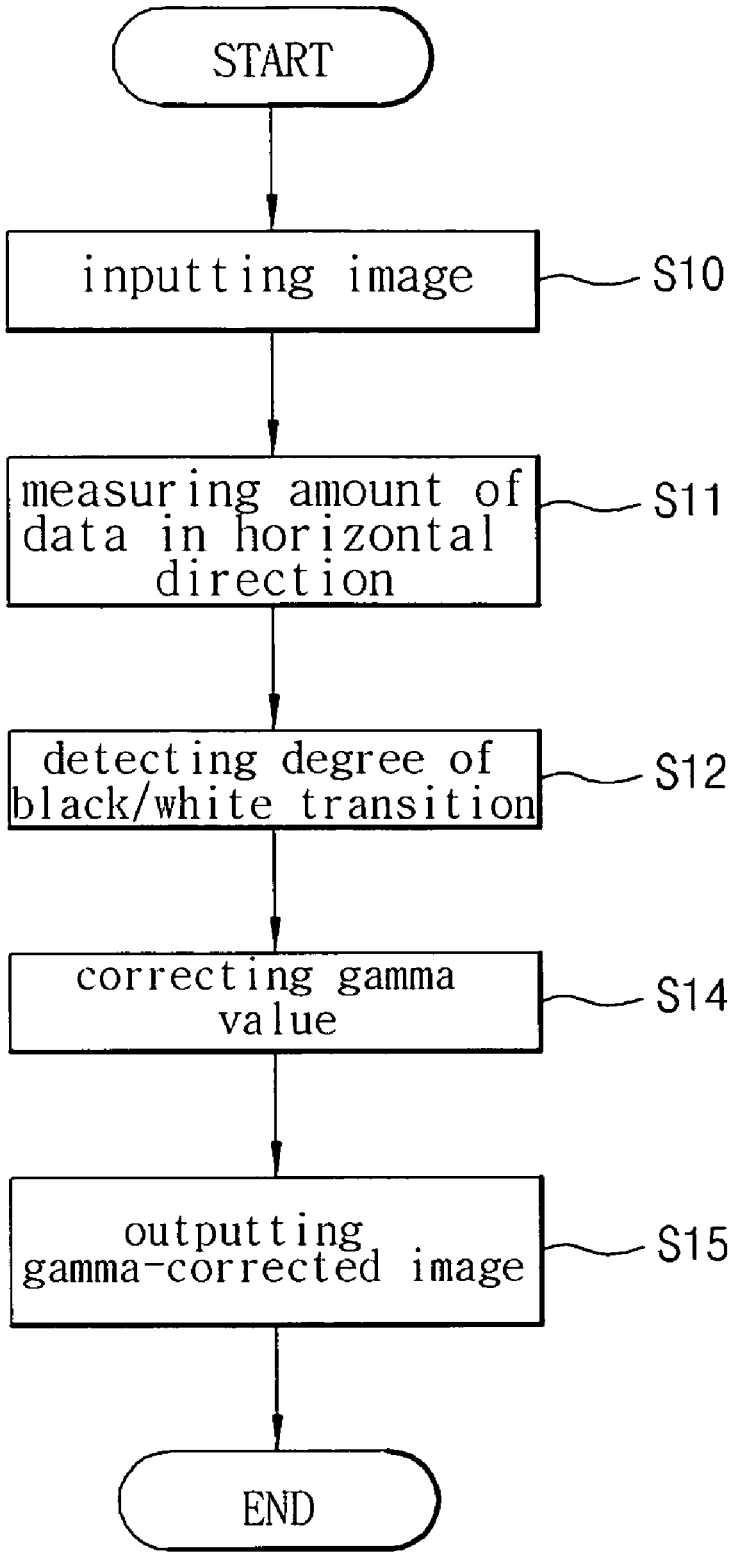
FIG. 4 is a flow chart illustrating a dynamic gamma control process in accordance with an exemplary embodiment of the present invention.
Figure 5:
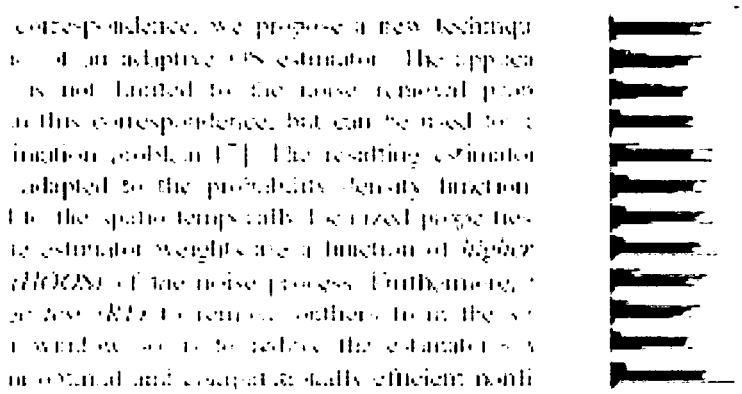
FIG. 5 is a view showing an example of an image with a large degree of black/white transition.
Figure 6:
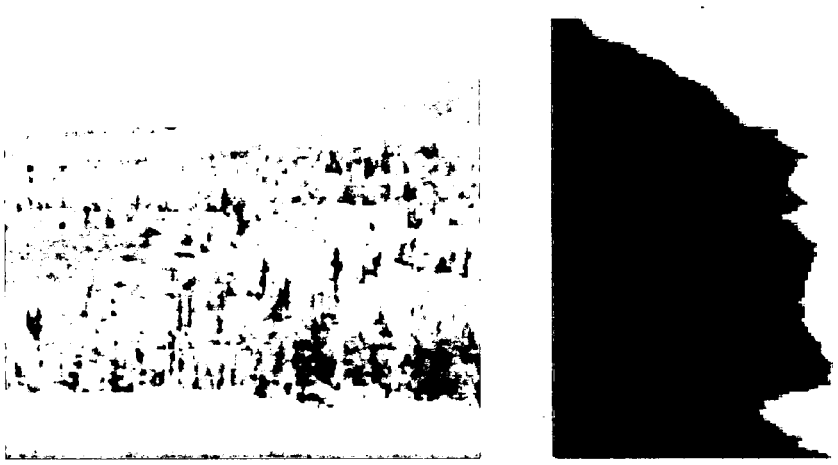
FIG. 6 is a view showing an example of an image with a small degree of black/white transition.
Figure 7:
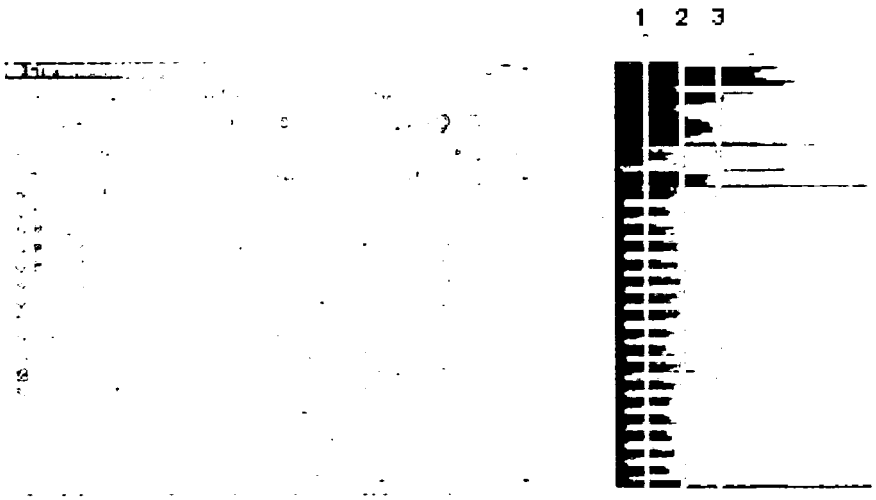
FIG. 7 is a view showing an example of an image with a plurality of black/white transition reference values.

FIG. 4 is a flow chart illustrating a dynamic gamma control process in a light emitting device display according to the exemplary embodiment of the present invention. In addition, FIGS. 5 to 7 show various images having different degrees of black/white transitions. For instance, FIG. 5 is a view showing an example of an image with a large degree of black/white transition, and FIG. 6 is a view showing an example of an image with a low degree of black/white transition. FIG. 7 is a view showing an example of an image with a plurality of black/white transition reference values.

As shown in FIG. 4, an image is applied to the pixel circuit unit 12 at step S10. The image displayed on the pixel circuit unit 12 may be a text image with a full white background for readability as shown on the left portion of FIG. 5, or a picture or video with diverse information as shown on the left portion of FIG. 6.

Next, an input image is recognized by analyzing the images in a horizontal direction at step S11. In particular, higher amounts of horizontal data correspond to darker images. Therefore, the degree of black/white transition can be determined and corresponding values obtained by analyzing the amount of data in the horizontal direction at each reference point. The degrees of black/white transition of a text-centric image in which text and background are repeated in horizontal direction and a general image in which various image information exist are shown on the right portions in FIGS. 5 and 6, respectively.

FIG. 7 is a view showing an example of an image with a plurality of black/white transition reference values. As shown in FIG. 7, the degree or number of times of black/white transitions is calculated at step S12 according to a plurality of reference values (shown by reference lines 1, 2, and 3) based on the obtained data values in the horizontal direction. Accordingly, the text image as shown in FIG. 5 has a high degree of black/white transition at reference point 1 but has a low degree of black/white transition at the reference points 2 and 3. Meanwhile, the picture or video image as shown in FIG. 6 has a low degree of black/white transition at all the reference points 1, 2, and 3. Accordingly, by employing the three reference lines, precision of the degree of black/white transition can be increased. As a result, in cases where the degree of black/white transition is high as shown in FIG. 5, the image may be determined as a text image with a full white background for readability, whereas in the case where the degree of the black/white transition is low, the image may be determined as a picture or video for multimedia application and not just for readability.

As shown in FIG. 4, a gamma value is corrected according to the degree of black/white transition at step S14. At step S15, if the degree of black/white transition is large as shown in FIG. 5, a gamma reference voltage or a gamma value with a smaller slope as shown in FIG. 3 is applied to the pixel circuit unit 12 to display the image. If the degree of black/white transition is low as shown in FIG. 6, a gamma reference voltage or a gamma value with a larger slope as shown in FIG. 3 is applied to the pixel circuit unit 12 to display the image. In this manner, different gamma values may be applied according to the degree of black/white transition of an image displayed on the screen to suitable control luminance according to the image to be displayed.

In the above-described exemplary embodiment of the present invention, the display is an organic light emitting display with pixel circuit unit 12 having a plurality of LEDs 28. However, the pixel circuit unit 12 may be directed to various display devices such as a plurality of plasma display elements, liquid crystal display elements, light emitting devices, and an inorganic light emitting device without departing from the scope of the present invention.

In addition, in the above-described exemplary embodiment of the present invention, the LEDs 28 may be active matrix type organic light emitting elements. However, the LEDs 28 may be passive or simple matrix type light emitting elements in which an organic light emitting layer is formed at each position where first and second electrodes cross.

Further, in the above-described exemplary embodiment of the present invention, the degree of black/white transition is explained as a degree of transition from black-to-white in the vertical direction with respect to the total amount of data in the horizontal direction. However, the degree of black/white transition can be also calculated by the total amount of data on the entire screen without departing from the scope of the present invention.

Moreover, in the above-described exemplary embodiment of the present invention, the degree of black/white transition is measured based on three reference lines. However, different number of reference lines may be used without departing from the scope of the present invention.

Furthermore, in the above-described exemplary embodiment of the present invention, the gamma corrector 22 is indicated as a separate unit. However, the gamma corrector 22 may be a digital gamma unit included in the data driver.

It will be apparent to those skilled in the art that various modifications and variations can be made in the light emitting display device of the present invention without departing form the spirit or scope of the invention. Thus, it is intended that the present invention cover the modifications and variations of this invention provided they come within the scope of the appended claims and their equivalents.

What is claimed is:

1. A display device, comprising:

a pixel circuit unit comprising a plurality of pixels to display an image;

a data driver to supply data signals to the pixel circuit unit;

a scan driver to supply scan signals to the pixel circuit unit;

a black/white transition detector to detect a degree of black/white transition within the image;

a gamma corrector to adjust the data signal by providing a gamma value to the data driver; and a timing controller to apply control signals to the data driver and the scan driver, receive the degree of black/white transition from the black/white transition detector, and provide a corrected gamma control signal to the gamma corrector according to the degree of black/white transition.

2. The device of claim 1, wherein the black/white transition detector determines the degree of black/white transition by analyzing image data to be displayed by the pixel circuit unit.

3. The device of claim 2, wherein the black/white transition detector determines the degree of black/white transition by calculating a total of image data in a horizontal direction and then determining a number of times the total in the horizontal direction exceeds a predetermined reference value in a vertical direction.

4. The device of claim 3, wherein a plurality of predetermined reference values are used by the black/white transition detector.

5. The device of claim 1, wherein the gamma corrector is a digital gamma unit existing in the data driver.

6. The device of claim 1, wherein the pixels are organic light emitting elements.

7. The device of claim 1, wherein the black/white transition detector determines the degree of black/white transition by calculating a total of the image data of an entire image.

8. A dynamic gamma control method in a display, comprising:

receiving image data of an image to be displayed on a screen;

outputting the image data onto the screen;

detecting a degree of black/white transition within the image; and controlling luminance of the image output onto the screen by applying a gamma value that has been corrected according to the degree of black/white transition.

9. The method of claim 8, wherein the degree of black/white transition is determined by analyzing the image data to be displayed by a pixel circuit unit.

10. The method of claim 9, wherein a total of the image data in a horizontal direction is calculated and then the number of times the total in the horizontal direction exceeds a predetermined reference value in a vertical direction so as to determine the degree of black/white transition.

11. The method of claim 10, wherein a plurality of predetermined reference values are used in the black/white transition detecting step.

12. The method of claim 8, wherein the image is output onto the screen having organic light emitting elements.

13. The method of claim 8, wherein the degree of black/white transition by calculating a total of the image data of an entire image.

* * * * *